United States Patent [19]

Hoffman

[11] Patent Number: 4,598,489

[45] Date of Patent: Jul. 8, 1986

[54] TAG FOR A CONTAINER

[75] Inventor: Klaus-Peter Hoffman, Ellerbek, Fed. Rep. of Germany

[73] Assignee: Colgate-Palmolive Company, New York, N.Y.

[21] Appl. No.: 656,113

[22] Filed: Sep. 28, 1984

[30] Foreign Application Priority Data

Sep. 30, 1983 [DE] Fed. Rep. of Germany ... 8328150[U]

[51] Int. Cl.[4] ..... G09F 3/00

[52] U.S. Cl. ..... 40/310; 40/2 R

[58] Field of Search ..... 40/310, 311, 317, 331, 40/332, 2 R

[56] References Cited

U.S. PATENT DOCUMENTS

| | | | |
|---|---|---|---|
| 1,853,622 | 4/1932 | Kennedy | 40/310 |
| 2,138,361 | 11/1938 | Snellino | 40/310 |
| 2,222,166 | 11/1940 | Beline | 40/310 |
| 3,149,431 | 9/1964 | Blish | 40/310 |
| 3,423,861 | 1/1969 | Forsyth | 40/310 |

*Primary Examiner*—John J. Wilson
*Assistant Examiner*—James Hakomaki
*Attorney, Agent, or Firm*—Herbert S. Sylvester; Murray M. Grill; John A. Stemwedel

[57] ABSTRACT

A foldable, flexible tag having a central opening and an auxiliary opening adapted to fold over a connecting fold line so that the center of the auxiliary opening is further from the fold line than is the center of the auxiliary opening.

5 Claims, 7 Drawing Figures

TAG FOR A CONTAINER

Figure 1:
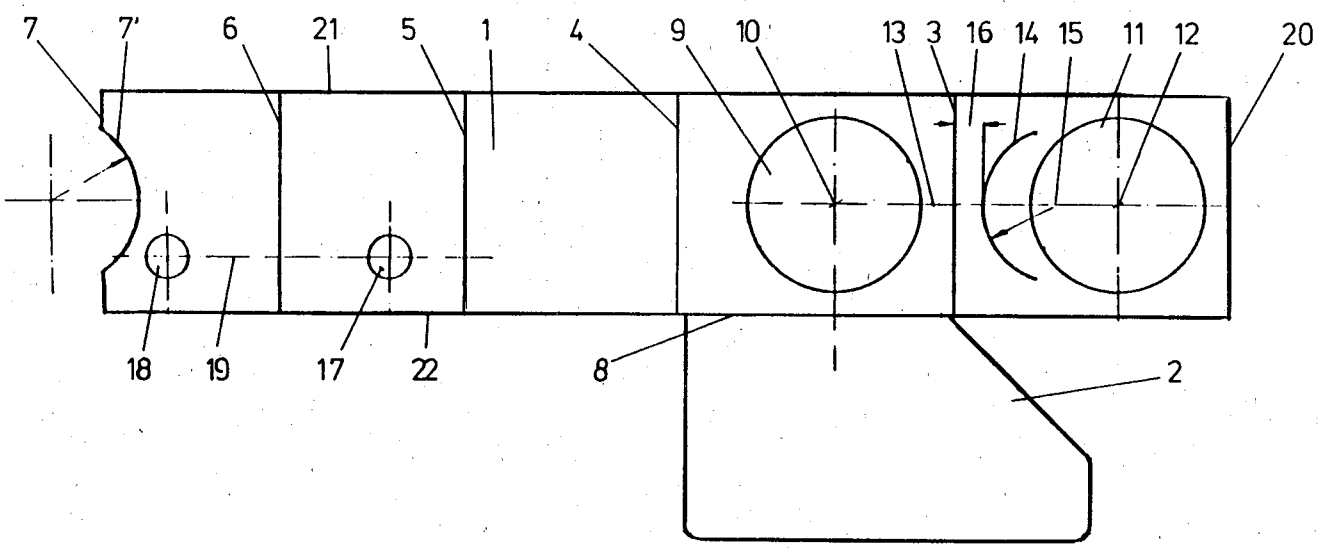

The invention relates to a tag made from a foldable, flexible material for a container with a closure, whose external diameter is larger at the lower end than the external diameter of the container region located immediately below the lower end, with at least one circular opening provided in the tag and whose diameter is slightly larger than the maximum external diameter of the closure.

Paper, cardboard or plastic foil tags are widely used, in order to carry advertisements and the like, which are necessary for specific sales campaigns and do not form part of the adhesively affixed label. In general, such a tag has an annular region, which can be pushed over the closure and into the area immediately below the closure, as well as a label area carrying the advertisement and which follows onto the annular area.

As the opening in the annular area has a diameter which is larger than the maximum diameter of the closure, it is very easy to remove the tag, so that frequently containers are offered for sale which, undesirably, no longer carry the tag. In addition, the tag does not have a stable position of the container, so that the label area can assume different positions in individual containers.

It is an object of the invention to provide a tag which cannot be easily detached from the container and is held thereon in a substantially predetermined position.

According to the invention, this object is attained in that a tag of the aforementioned type is so constructed that adjacent to the opening, an auxiliary opening of the same size is provided, between which and the opening is provided a folding line at right angles to the connecting line of the centers of the opening and the auxiliary opening and which is further from the auxiliary opening than from the opening.

Thus, in the case of the tag according to the invention, there are two openings to then be passed over the closure after folding about the folding line. However, after swivelling around the folding line, they are not superimposed in alignment and are instead laterally displaced from one another. Thus, the opening and auxiliary opening can only be moved over the closure following a certain deformation of the tag, while below the closure, where the container dimensions are significantly smaller than the diameter of the opening and auxiliary opening, the corresponding areas of the tag can be oriented again in such a way that the opening and auxiliary opening are superimposed in non-aligned manner. The detachment of the tag from the container is made more difficult by the resulting displacement of opening and auxiliary opening.

The displacement of the superimposed opening and auxiliary opening is preferably chosen in such a way that the resulting minimum internal opening diameter is slightly larger than the diameter of the container in this area. According to a preferred development, the distance between the center of the opening and the folding line represents 40 to 45% of the distance between the centers of the opening and the auxiliary opening.

In order to additionally secure the tag applied to the container, in the area between the folding line and the nearer edge of the auxiliary opening, there can be provided an arcuate groove, whose center is located on the connecting line of the centers of the opening and the auxiliary opening and is closer to the center of the auxiliary opening than the groove and whose radius is smaller than the radius of the opening, the minimum distance of the groove from the folding line being smaller than the minimum distance of the opening from the folding line and the ends of the groove, in the case of swivelling above the folding line and superimposed opening and auxiliary opening, being located within the opening.

When such a tag has been placed on a container and the opening and auxiliary opening are located in the area immediately below the closure, the region having the convex edge and connected to the groove can be displaced in the direction of the openings and its edge can be forced through the opening, accompanied by flexible deformation. The edge area of the groove adjacent to the connecting line of the centers of the opening and the auxiliary opening is then superimposed on the adjacent edge of the opening, so that additional security is provided against the removal or loss of the tag fitted to the container.

At least one additional folding line can be provided between the opening and the outer end facing the auxiliary opening and the terminal edge of the outer end can be concavely curved, at least in the central portion. As a result, the outer end can be swivelled about the additional folding line, so that the terminal edge of the outer end engages on the container and is kept positioned and supported thereon by said concave central portion.

In the case of such a construction, it is possible to have two identically large reception openings at the same distance on either side of the additional folding line and located on a straight line at right angles to the additional folding line. An elongated object can be passed through the said reception openings and as a result of its weight forces the terminal edge of the outer end against the container and is held in a substantially vertical position. Such an elongated object can, for example, be an advertising gift accompanying the container.

Figure 2:
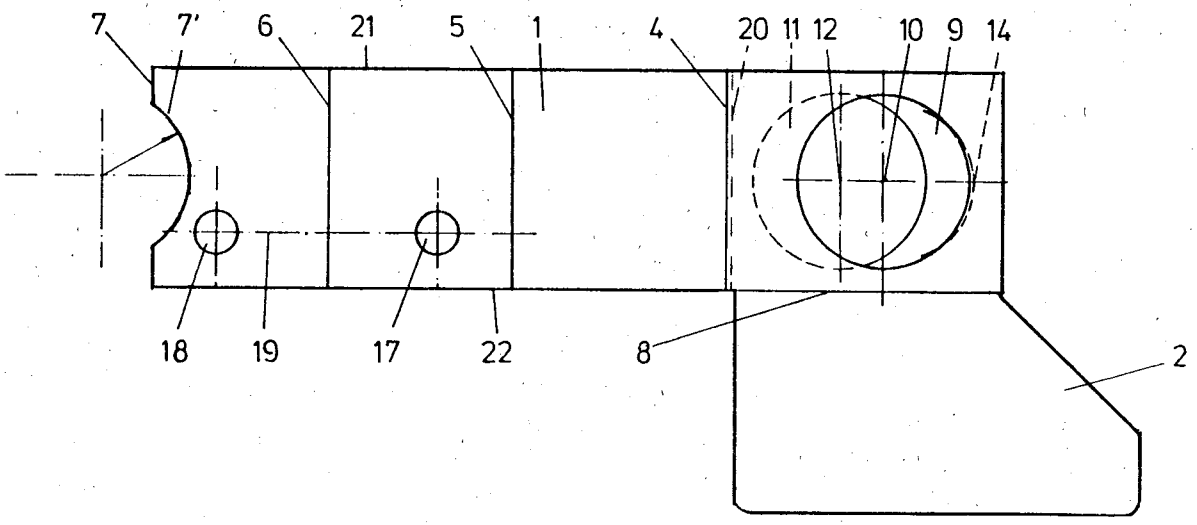

The invention is described in greater detail hereinafter relative to a non-limitative embodiment and the attached drawings, wherein FIG. 1 is a plan view of the blank for a tag;

FIG. 2 is a plan view of the blank of FIG. 1 with an auxiliary opening swivelled about a folding line and positioned below the opening;

FIGS. 3 to 7 perspective partial views of the fitting of the tag on a bottle-like container.

Tag 1 shown in FIG. 1 in the form of a blank is essentially shaped like an elongated, rectangular strip with parallel lateral edges 21, 22 and terminal edges 7, 20 at right angles thereto, the central portion 7' of terminal edge 7 having a concave arcuate configuration. The strip contains a circular central opening 7, whose center 10 is positioned midway between lateral edges 21, 22. In addition, in the vicinity of the terminal edge 20, there is a circular auxiliary opening 11, whose center 12 is also positioned in the middle between lateral edges 21, 22, i.e. is positioned on straight line 13 and its diameter is the same as the diameter of opening 9. Between opening 9 and auxiliary opening 11, there is a folding line 3 running at right angles to straight line 13 and which is positioned closer to opening 9 than to auxiliary opening 11.

In the area between folding line 3 and auxiliary opening 11, there is an arcuate groove 14, whose center 15 is arranged in the vicinity of auxiliary opening 11 on straight line 13. The arc radius of groove 14 is slightly smaller than the radius of opening 9. The groove is symmetrical to the straight line 13 and extends over a center angle of approximately 150°. The minimum spacing 15 between folding line 3 and groove 14 is slightly smaller than the minimum spacing between folding line 3 and opening 9.

A label area 2, on which is normally printed advertisements, is shaped onto lateral edge 22 adjacent to opening 9 and over a folding line 8. Close to transverse edge 7 and parallel thereto is provided a folding line 6 and between the latter and opening 9 there are two further folding lines 4, 5, which run parallel to folding line 6.

On either side of folding line 6 and equidistantly therefrom, are provided circular reception openings 17, 18, whose centers are on a straight line 19 running parallel to lateral edge 22. Thus, on swivelling about folding line 6, these reception openings are in alignment over one another.

In order to fit the tag to a container, as described hereinafter in conjunction with FIGS. 3 to 7, the area carrying auxiliary opening 11 is folded around the folding line 3, so that it is positioned below the area carrying opening 9 (FIG. 2). Due to their different distances from folding line 3, in this position centers 10 and 12 of opening 9 and auxiliary opening 11 are displaced relative to one another, so that there is a free passage area, which is smaller than opening 9 or auxiliary opening 11 (FIG. 2). In this position, the ends of groove 14 extend into the area of opening 9, while the area of the groove located on straight lines 13 is positioned slightly outside the area of opening 9, as indicated in FIG. 2.

After the tag has been brought into this position according to FIG. 2, it can be placed on a bottle-like container 30 (FIGS. 3 to 7) of which only the upper area is shown, which has a closure 31 with a cut-off spout 32. Thus, below closure 31 is formed receiving space 33 between the closure and the container and the tag is fixed therein.

Figure 3:
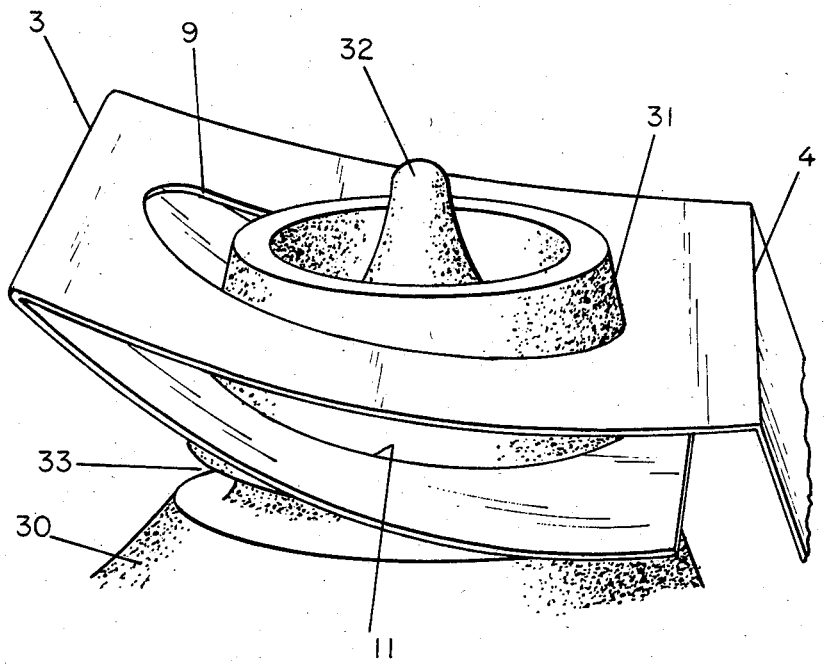
Figure 4:
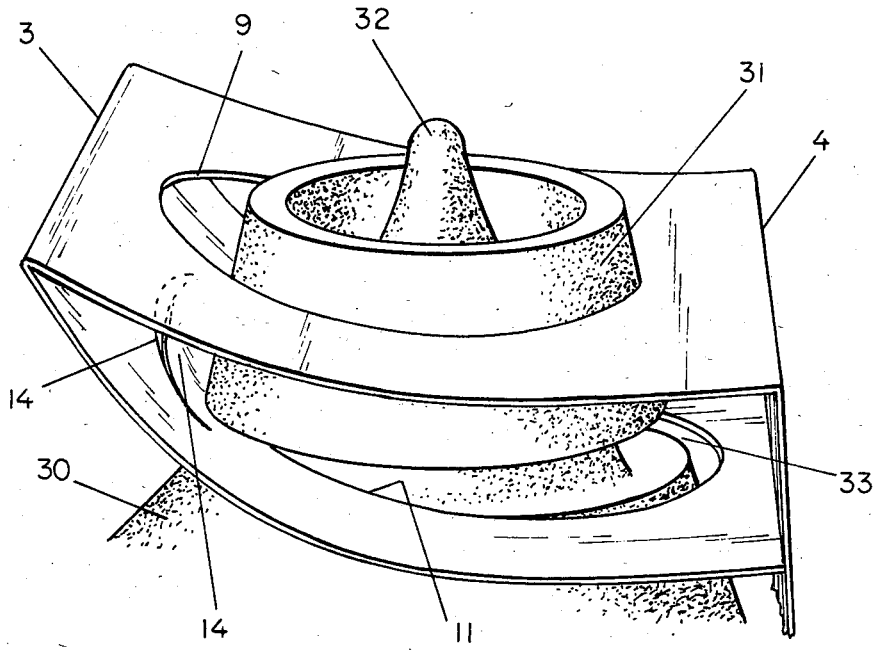
Figure 5:
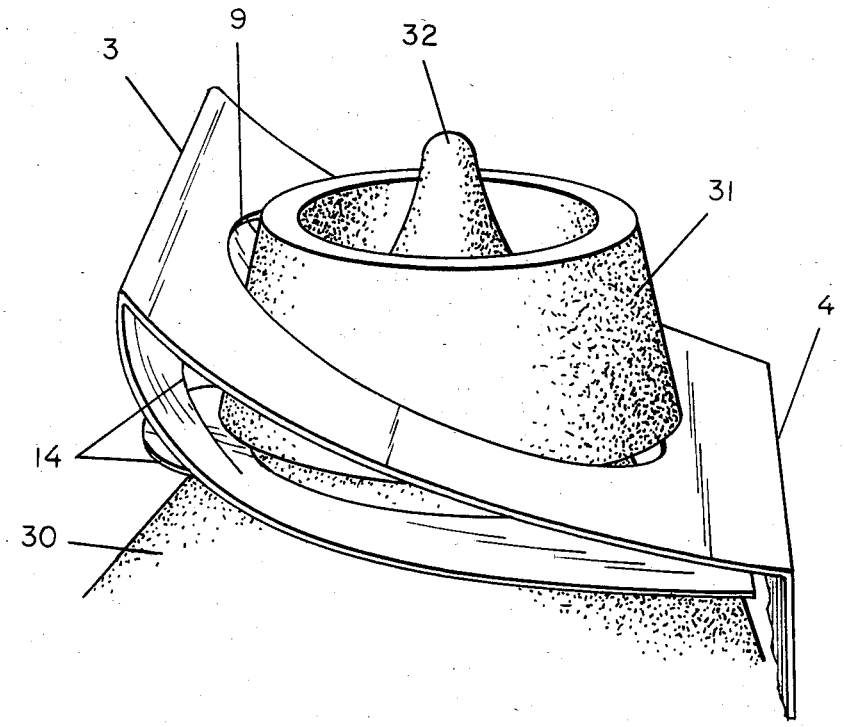
Figure 6:
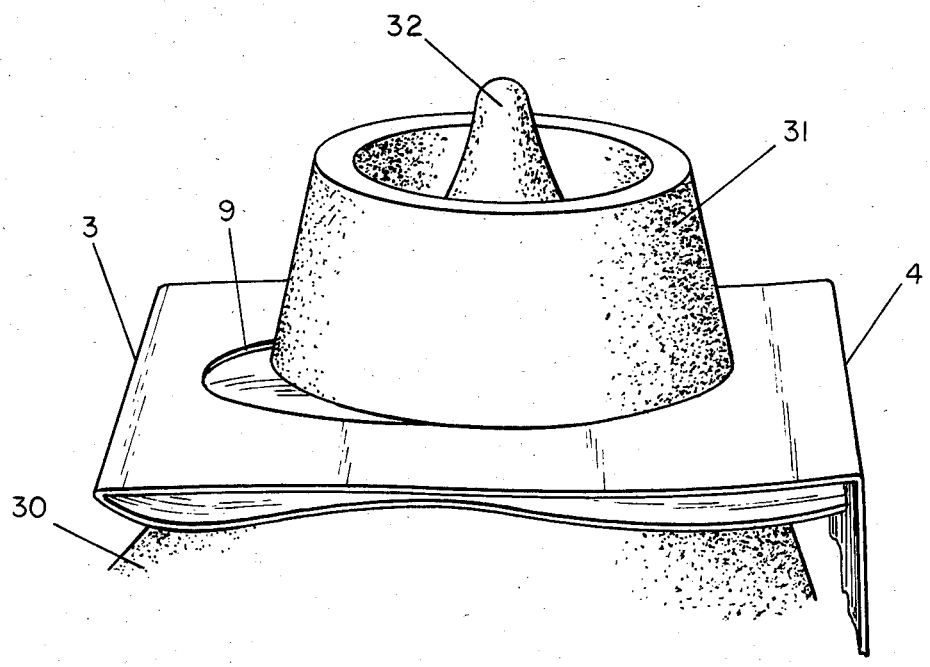
Figure 7:
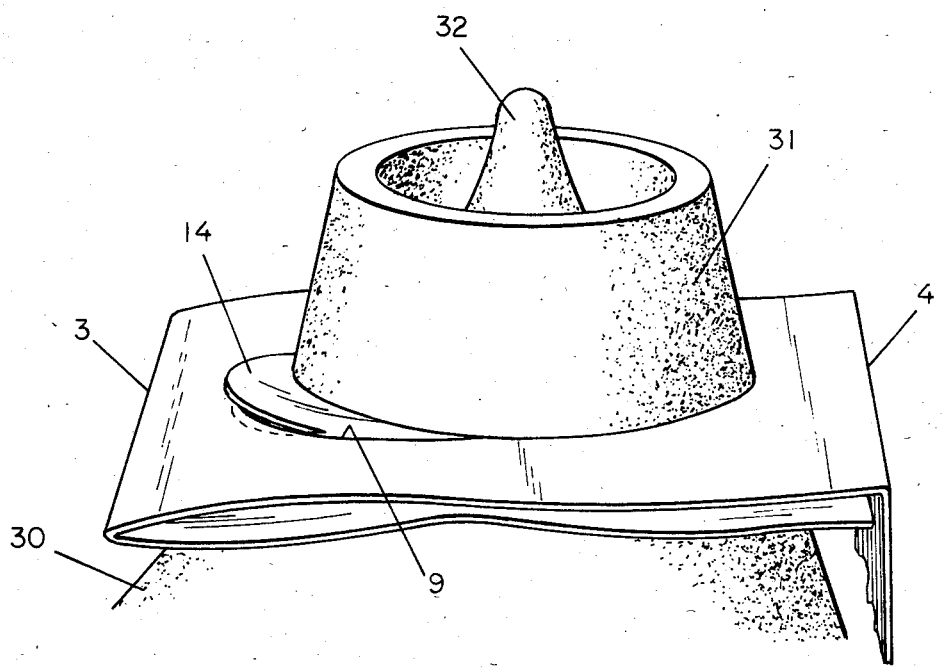

As shown in FIG. 3, initially the auxiliary opening is moved in the direction of receiving space 33, while opening 9 still remains in the upper area of closure 31. This takes place through a corresponding deformation of the material areas of the tag carrying auxiliary opening 11 and opening 9. When auxiliary opening 11 has been brought into the area of receiving space 33 (FIG. 4), the opening 9 is moved further downwards along the outer face of closure 31 and the area carrying auxiliary opening 11 is flexibly deformed, while the edges of groove 14 are separated from one another (FIG. 4). When the right-hand edge area of opening 9 in FIGS. 3 to 7 has been introduced into receiving space 33, said area can be drawn to the left into the receiving space and consequently the complete opening 10 can be moved into the area of the receiving space (FIG. 6). After reaching this position, the areas adjacent to folding line 3 are drawn further downwards, so that the convex edge of receiving space 14 is forced upwards and passes through opening 9. This prevents an unintentional upwards movement of the material area carrying opening 9 and the tag is reliably positioned in the vicinity of receiving space 33.

If the tag is to be removed, then the reverse order to what is shown in FIGS. 3 to 7 is adopted, namely firstly the areas adjacent to folding lines 3 are pressed upwards in order to bring the convex edge of groove 14 out of the area of opening 9, then opening 9 is moved out of the groove and in corresponding order the complete tag is removed.

When the tag is fitted, the area on the side of folding line 4 remote from opening 9 is curved downwards and the following area of the material strip is curved upwards somewhat about folding line 5, whereas the area having the transverse edge 7 is folded downwards about folding line 6, so that the concave central portion 7' is located in the vicinity of the container wall. If then an elongated object is passed through the two reception openings 17, 18 and is held in the latter, the central portion 7' is pressed against the container wall due to the weight of the object and in said alignment of reception opening 17, 18 the object is held in a precisely reproducible position.

I claim:

1. A tag made from a foldable, flexible material for a container with a closure, whose external diameter is larger at the lower end than the external diameter of the container region located immediately below the lower end of the closure, with at least one circular opening provided in the tag and whose diameter is slightly larger than the maximum external diameter of the closure, characterized in that adjacent to the opening, an auxiliary opening of the same size is provided, between which and the opening is provided a folding line at right angles to the connecting line of the centers of the opening and the auxiliary opening and which is further from the auxiliary opening than from the opening.

2. A tag according to claim 1, characterized in that the distance between center of opening and folding line only amounts to 40 to 45% of the distance between the centers of opening and auxiliary opening.

3. A tag according to claim 1, characterized in that in the area between the folding line and the nearer edge of the auxiliary opening, there is provided an arcuate groove, whose center is located on the connecting line of the centers of the opening and the auxiliary opening and is closer to the center of the auxiliary opening than the groove and whose radius is smaller than the radius of the opening, the minimum distance of the groove from the folding line being smaller than the minimum distance of the opening from the folding line and the ends of the groove, in the case of swivelling about the folding line and superimposed opening and auxiliary opening, being located within the opening.

4. A tag according to claim 1, characterized in that between the opening and the outer end facing auxiliary opening, there is at least one additional folding line parallel to the first folding line, and that the terminal edge of the outer end is concavely curved at least in the central portion.

5. A tag according to claim 4, characterized by two identically large reception openings, located at the same distance on either side of the additional folding line on a straight line, at right angles to the additional folding line.

* * * * *